US008022298B2

(12) United States Patent
Husain et al.

(10) Patent No.: US 8,022,298 B2
(45) Date of Patent: Sep. 20, 2011

(54) WEATHERPROOF OUTLET AND GASKET ASSEMBLY

(75) Inventors: Mahran Husain, South Bend, IN (US); Robert W. Jorgensen, Niles, MI (US)

(73) Assignee: Hubbell Incorporated, Shelton, CT (US)

( * ) Notice: Subject to any disclaimer, the term of this patent is extended or adjusted under 35 U.S.C. 154(b) by 490 days.

(21) Appl. No.: 12/216,258

(22) Filed: Jul. 1, 2008

(65) Prior Publication Data

US 2010/0000757 A1 Jan. 7, 2010

(51) Int. Cl.
*H01H 9/02* (2006.01)

(52) U.S. Cl. ..... 174/53; 174/481; 174/539; 174/67; 220/3.2; 220/3.3; 220/242

(58) Field of Classification Search ..... 174/480, 174/481, 482, 485, 50, 53, 57, 58, 135, 66, 174/67, 483, 539, 17 CT; 220/3.2–3.9, 4.02, 220/241, 242; 439/535, 536
See application file for complete search history.

(56) References Cited

U.S. PATENT DOCUMENTS

| | | | | |
|---|---|---|---|---|
| 2,239,653 | A | 4/1941 | O'Brien | |
| 2,524,250 | A | 10/1950 | Bierce | |
| 2,650,262 | A | 8/1953 | Abbott | |
| 2,867,345 | A | 1/1959 | Bellek | |
| 2,870,933 | A | 1/1959 | Winter | |
| 3,201,740 | A | 8/1965 | Rubens | |
| 3,252,611 | A | 5/1966 | Weitzman et al. | |
| 3,845,234 | A * | 10/1974 | Brenner | 174/67 |
| 3,956,573 | A * | 5/1976 | Myers et al. | 174/488 |
| 4,058,358 | A | 11/1977 | Carlisle | |
| 4,343,411 | A * | 8/1982 | Chesnut et al. | 174/67 |
| 4,456,145 | A | 6/1984 | Frank | |
| 4,484,021 | A | 11/1984 | Schaefer et al. | |
| 4,505,403 | A | 3/1985 | Bowden, Jr. et al. | |
| 4,618,740 | A | 10/1986 | Ray et al. | |
| 5,013,877 | A | 5/1991 | Jervis | |
| 5,017,153 | A | 5/1991 | Bowman | |
| 5,107,072 | A | 4/1992 | Morgan | |
| 5,280,135 | A | 1/1994 | Berlin et al. | |
| 5,342,995 | A | 8/1994 | Comerci et al. | |
| 5,763,831 | A | 6/1998 | Shotey et al. | |
| 5,779,083 | A * | 7/1998 | Bordwell | 174/67 |
| 6,265,662 | B1 * | 7/2001 | Riedy et al. | 174/67 |
| 6,450,353 | B1 * | 9/2002 | Riedy et al. | 174/485 |
| D482,661 | S | 11/2003 | Shotey et al. | |
| 6,642,453 | B2 | 11/2003 | Shotey et al. | |
| 6,680,438 | B1 | 1/2004 | Campbell et al. | |
| 6,891,104 | B2 | 5/2005 | Dinh | |
| 7,064,268 | B2 * | 6/2006 | Dinh | 174/485 |
| 7,227,079 | B2 * | 6/2007 | Noest et al. | 174/50 |

(Continued)

*Primary Examiner* — Angel R Estrada
(74) *Attorney, Agent, or Firm* — Garrett V. Davis; Mark S. Bicks; Alfred N. Goodman

(57) ABSTRACT

A weatherproof outlet includes a base plate for coupling to an electrical box and a hinged cover. The base plate has at least one opening for accessing an electrical wiring device such as an electrical receptacle mounted in the electrical box. The top surface of the base plate includes an inner rim and an outer rim having a dimension to shed water away from the access opening and the wiring device. A weatherproof gasket is attached to the top surface of the base plate within the confines of the inner wall and overlying the access opening. The gasket includes a plurality of slits for receiving the prongs of a plug and to form a waterproof seal around the prongs when inserted into the slots of an electrical receptacle.

39 Claims, 5 Drawing Sheets

U.S. PATENT DOCUMENTS 7,265,292 B2 * 9/2007 Greenfield ..... 174/67
7,319,193 B2 * 1/2008 Halterman ..... 174/67
7,459,632 B2 * 12/2008 Bowman ..... 174/66
7,484,973 B2 * 2/2009 Westhoff ..... 439/147

* cited by examiner

WEATHERPROOF OUTLET AND GASKET ASSEMBLY

FIELD OF THE INVENTION

The present invention relates to a weatherproof outlet having a gasket for sealing an electrical outlet. More particularly, the invention relates to a weatherproof outlet having a gasket attached to the outer surface of a base plate which forms a seal between the plug and the electrical receptacle and between a cover and the base plate of the assembly.

BACKGROUND OF THE INVENTION

Conventional electrical outlets for outdoor use include a receptacle mounted in a weatherproof outlet box which is closed by a weatherproof cover. When the receptacle is a duplex outlet, the cover plate can have two openings and two covers or flaps mounted adjacent the openings. The flaps or covers are hinged on the cover plate for movement between open and closed positions relative to the openings and are spring biased towards their closed positions. The openings in the cover plate enable access to the electrical contacts in the receptacle.

Rubber gaskets are commonly positioned between the cover plate and the outlet box and overlying the electrical receptacle. The gasket has an opening larger than the electrical device such that the gasket forms a seal between the outlet box and the cover plate and does not form a seal between the cover plate and the electrical receptacle. These devices typically require a separate gasket or seal for the cover flaps to form a weatherproof seal.

The use of separate seals for cover flaps increases the manufacturing and assembly costs. The separate seals also result in an increase in the possibility of leakage of water and dirt into the outlet box or into the receptacle causing damage and shorting of the electrical, components.

One example of a gasket for covering an electrical outlet box is disclosed in U.S. Pat. No. 4,058,358 to Carlisle. This patent discloses a gasket providing a seal between an outlet box and a cover plate and is positioned between the cover plate and the receptacle. This patent also discloses the gasket having a collar extending between the cover plate and, the cover flap. The gasket forms a seal when the cover flap is closed.

Another electrical box outlet seal is disclosed in U.S. Pat. No. 4,484,021 to Schaefer et al. This patent discloses a seal positioned between a cover plate and an electrical box. The gasket has a dimension to extend through the opening in the cover plate and is pressed through the opening in the cover plate by an electrical receptacle when the cover plate is attached to the electrical receptacle. The gasket is stretched and deformed out of the plane in the gasket to form a peripheral lip which extends through the opening in the cover plate and surrounds the receptacle projecting portion. The resulting lip contacts the cover flap when in the closed position to form a seal.

Other types of weatherproof electrical covers include a base that is attached to the electrical device and a hinged cover connected to the base. The cover has a dimension such that the cover can be completely closed when a plug is inserted into the electrical receptacle. Examples of this type of weatherproof cover are disclosed in U.S. Pat. No. 5,280,135 to Berlin et al, U.S. Pat. No. 6,891,104 to Dinh, U.S. Pat. No. 5,763,831 to Shotey et al. and U.S. Pat. No. 6,642,453 to Shotey et al.

Various other designs of weatherproof outlet covers are known in the art which include a gasket material either on the base which forms a seal with a hinged cover as disclosed in U.S. Pat. No. 4,058,358 to Carlisle or which include a gasket on the hinged cover as disclosed in U.S. Pat. No. 2,867,345 to Bellek and U.S. Pat. No. 2,870,933 to Winter.

These devices are generally suitable for their intended purpose. However, there is a continuing need in the industry for an improved weatherproof cover assembly that is effective and simple to construct.

SUMMARY OF THE INVENTION

The present invention is directed to a weatherproof cover assembly to protect an electrical wiring device. The invention is particularly directed to a weatherproof assembly having a gasket to prevent water from entering the electrical wiring device and the electrical enclosure.

Accordingly, an object of the present invention is to provide an improved housing for an electrical wiring device such as an electrical outlet receptacle which includes a gasket to effectively protect the electrical wiring device from damage from the environment.

Another aspect of the invention is to provide a gasket for an electrical outlet formed as a single unitary and continuous member which is able to form a seal between a cover plate and a cover. The gasket also forms a seal between the plugs and the electrical receptacle to prevent water and dirt from entering the openings in the receptacle.

A further aspect of the invention is to provide a weatherproof cover assembly that is economical to manufacture and simple to operate by the user.

A further aspect of the invention is to provide a weatherproof cover assembly having a mounting plate with guides and edges to shed water away from the electrical wiring device while providing effective sealing of the wiring device.

Still another aspect of the present invention is to provide an electrical outlet box with a gasket on an outer surface of the cover plate which is capable of forming a weatherproof seal with the hinged cover when in the closed position and to form a seal with a plug when the plug is connected to the outlet receptacle when the cover is in the opened position.

A further aspect of the invention is to provide a base plate for a cover assembly having a screw hole and a screw received in the screw hole for attaching the base plate to an electrical device and a gasket attached to a top surface of the base plate which captures the screw between the gasket and the base plate. The gasket has a hole overlying the screw with a width sufficient to allow the tip of a screw driver to engage the screw head. The hole in the gasket has a dimension less than the width of the screw head so that the screw is retained in the screw hole.

The foregoing aspects of the present invention are basically obtained by providing an electrical outlet comprising an electrical outlet box for supporting a wiring device, a base plate extending over the wiring device and the outlet box where the base plate has a least one access opening aligned with the wiring device, and a cover coupled to the base plate. The cover is movable between a first open position and a second closed position overlying the at least one access opening in the base plate. The electrical outlet also includes a resilient gasket having a top surface, a bottom surface and a peripheral outer edge and at least one opening aligned with the wiring device. The opening defines a self-sealing opening to access the wiring device. The gasket is attached to the base plate by an adhesive on a bottom surface around a peripheral edge to form a waterproof seal with the top surface of the base plate around the at least one access opening. The gasket has a dimension to form a seal with the cover when the cover is in the closed position.

The various aspects of the invention are also attained by providing a weatherproof outlet assembly comprising an electrical box having an open end and supporting an electrical receptacle, a base plate, a cover, and a resilient gasket. The base plate is coupled to the open end of the electrical box and overlying the electrical receptacle, top face, bottom face and an inner rim surrounding the at least one access opening and extending outwardly from the top face and has a dimension to shed water away from the access opening. The cover is coupled to the base plate and is movable between a first open position and a second closed position overlying the at least one access opening where the cover has a dimension less than a dimension of the inner rim of the base plate. The resilient gasket has a top surface, a bottom surface and a peripheral outer edge and at least one opening aligned with the electrical receptacle. The opening can be in the form of a slit defining a self-sealing opening to access the electrical receptacle. The resilient gasket is attached to the top surface of the base plate by an adhesive on the bottom surface thereof which extends around the peripheral edge. The gasket has an outer dimension complementing the inner dimension of the inner rim on the base plate and forms a waterproof seal around the at least one access opening. The top surface of the gasket forms a seal with the cover when the cover is in the closed position.

The various aspects of the invention are also attained by providing a weatherproof outlet comprising an electrical box having an open end and supporting an electrical receptacle, a base plate, a cover and a resilient gasket. The base plate is coupled to the open end of the electrical box and overlying the electrical receptacle. The base plate has two spaced apart access openings for receiving projections on the electrical receptacle, a top face, a bottom face and a continuous inner rim surrounding the access openings and extending outwardly from the top face. The inner rim has a dimension to shed water away from the access openings. The base plate further includes an outer rim spaced outwardly from the inner rim and has a height greater than the height of the inner rim with a dimension to shed water away from the inner rim. The cover is coupled to the base plate and is movable between a first opened position and a second closed position overlying at least one of the access openings. The cover has a dimension less than a dimension of the inner rim. The resilient gasket has top a surface, bottom surface and a peripheral outer edge and at least one slit aligned with the electrical receptacle. The slit defines a self-sealing opening to access the electrical receptacle. The gasket is attached to the top surface of the base plate by an adhesive on the bottom surface of the gasket and extends around the peripheral edge. The gasket has an outer dimension complementing an inner dimension of the inner rim on the base plate and forms a waterproof seal around the two access openings and forms a seal with the cover when the cover is in the closed position.

Other objects, aspects, advantages and salient features of the present invention will become apparent from the following detailed description which, taken in conjunction with the annexed drawings, discloses one embodiment of the present invention.

BRIEF DESCRIPTION OF THE DRAWINGS

Referring to the drawings which form a part of this original disclosure in which.

DETAILED DESCRIPTION OF THE INVENTION

Figure 1:
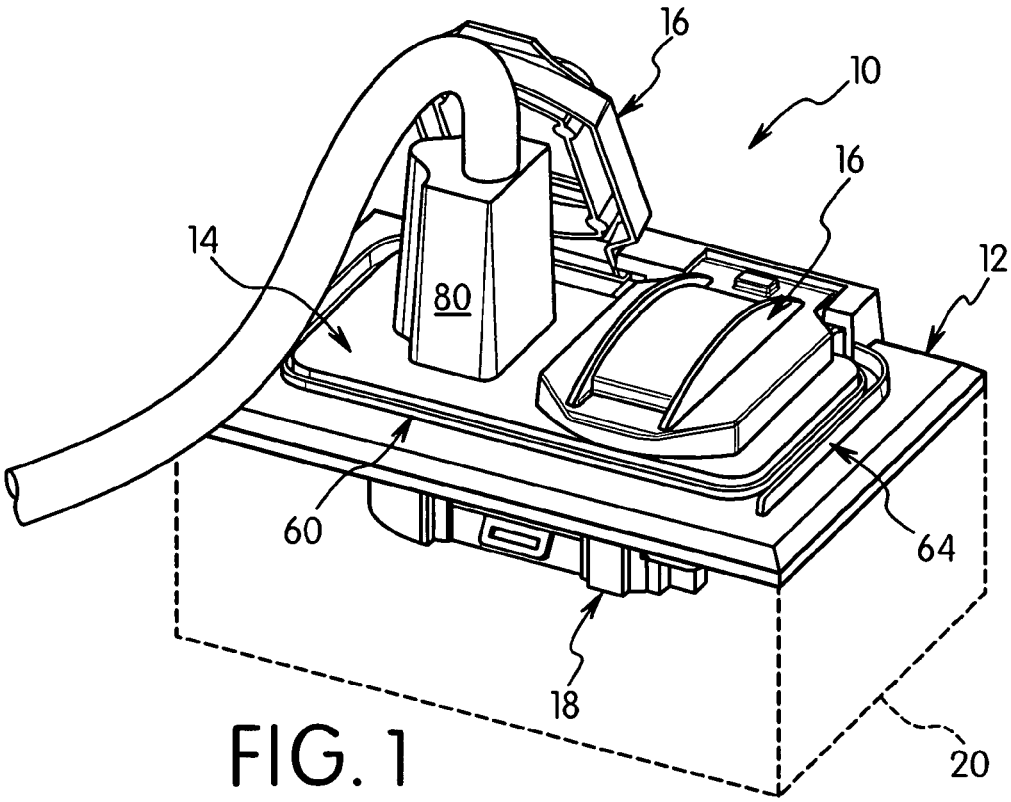
FIG. 1 is a perspective view of the cover plate assembly showing a plug inserted into the electrical receptacle.
Figure 2:
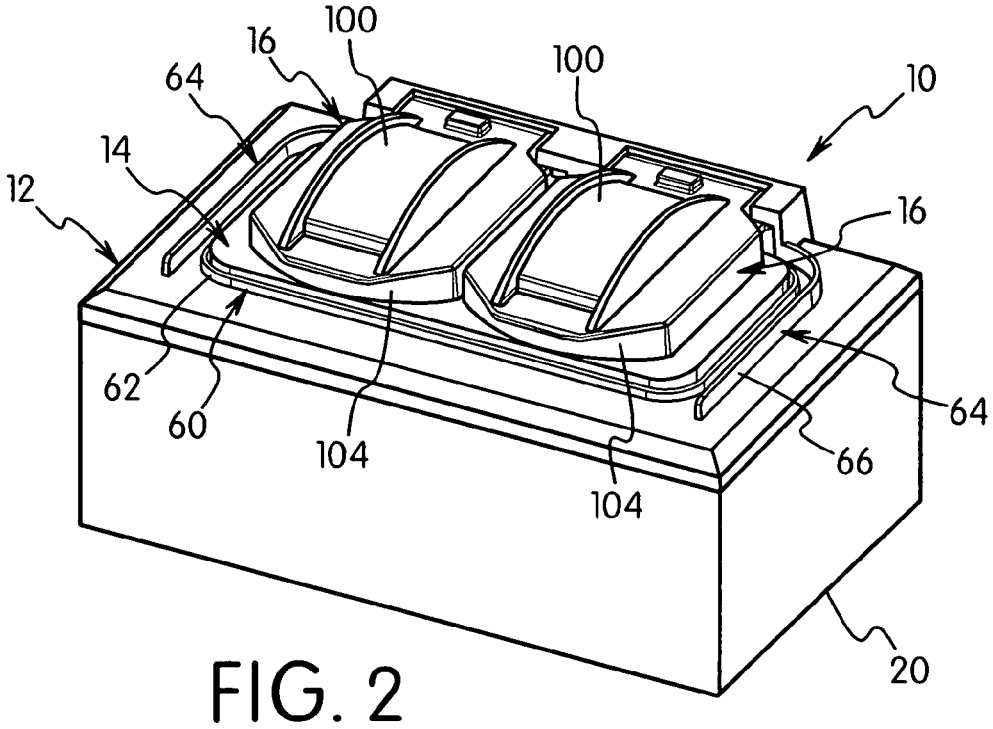
FIG. 2 is a perspective view showing the electrical outlet assembly with the covers in the closed position.

The present invention is directed to an electrical outlet assembly for outdoor use. In particular, the invention is directed to a weatherproof electrical assembly having a gasket to provide a weatherproof seal to prevent water and dirt from entering the electrical receptacle.

Referring to the drawings, the electrical outlet assembly 10 includes a base plate 12, and a gasket 14 attached to the cover 16. The cover is hinged to base plate 12.

Figure 3:
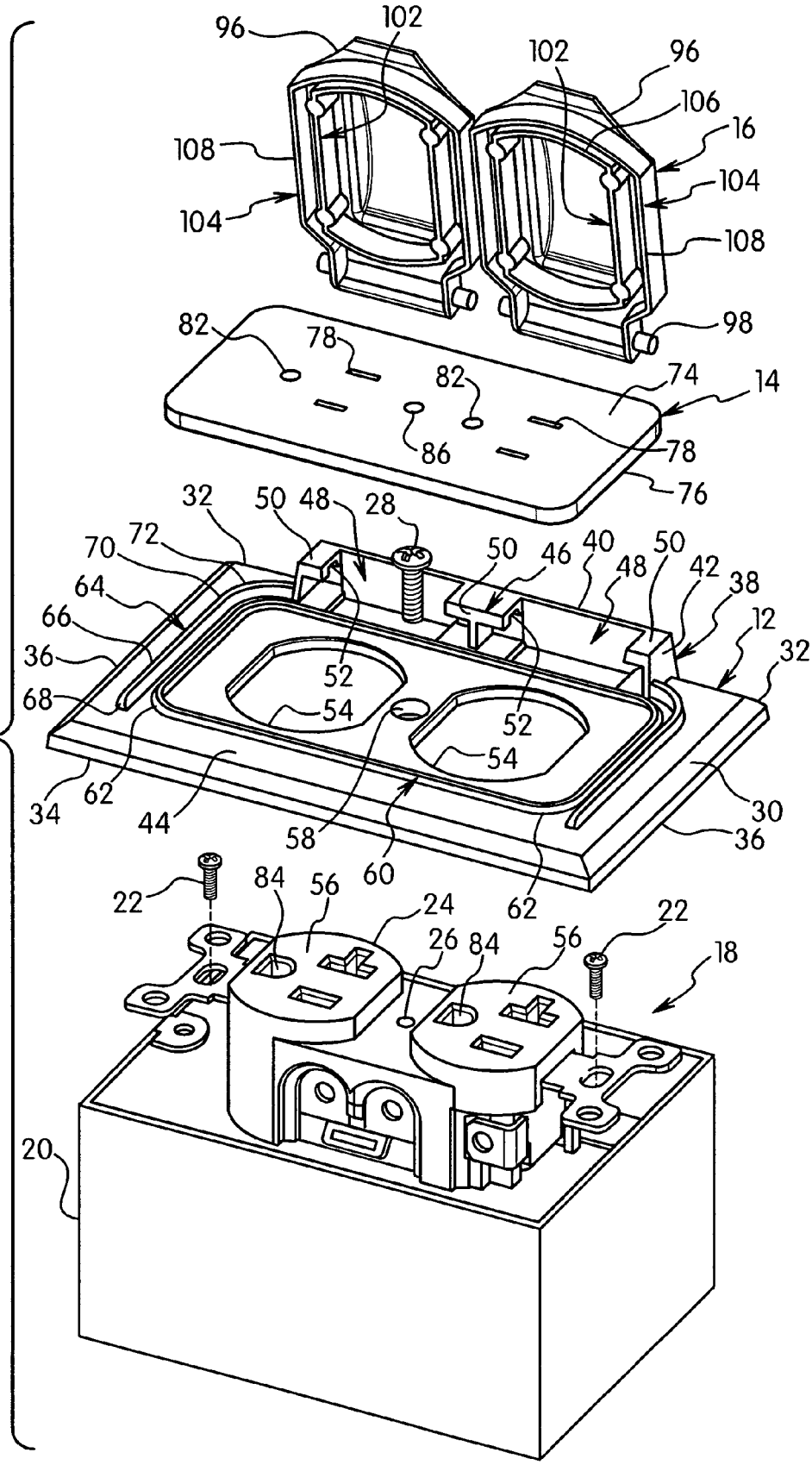
FIG. 3 is an exploded perspective view of the electrical outlet assembly of FIG. 2.
Figure 6:
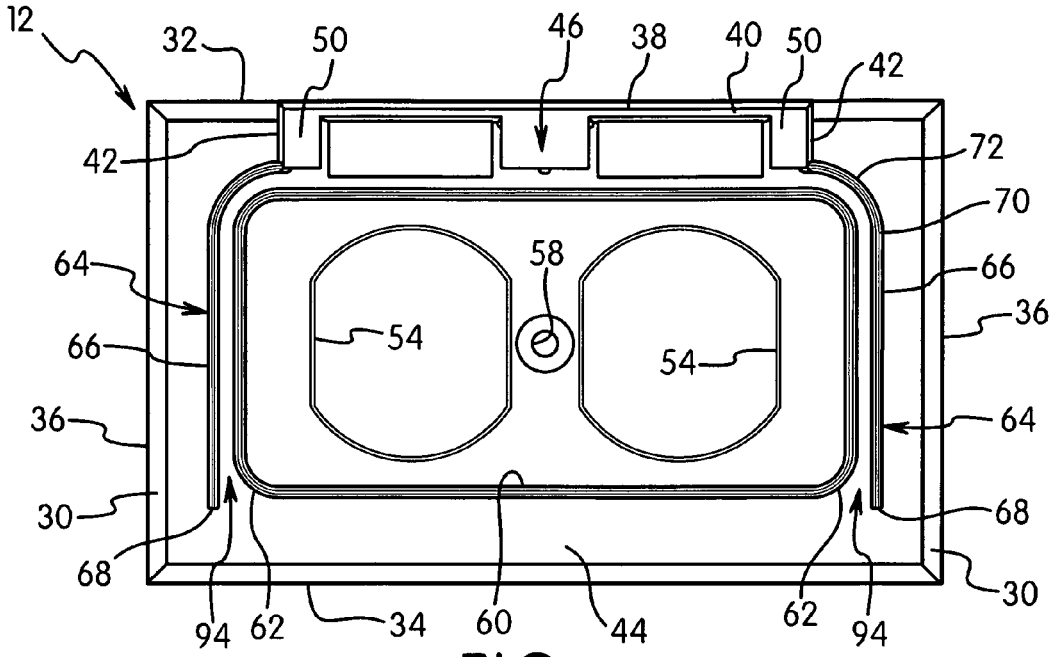
FIG. 6 is a top plane view of the cover plate of the electrical outlet assembly with the covers and gasket removed.
Figure 7:
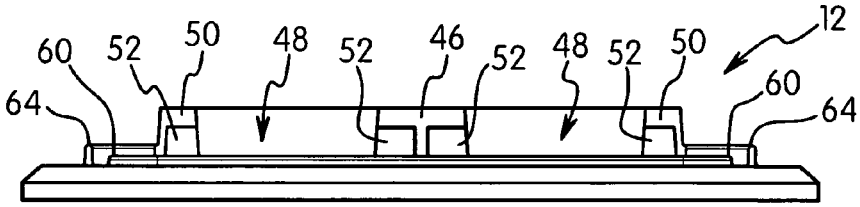
FIG. 7 is a front elevational view of the cover plate of the electrical outlet assembly of FIG. 6.
Figure 8:
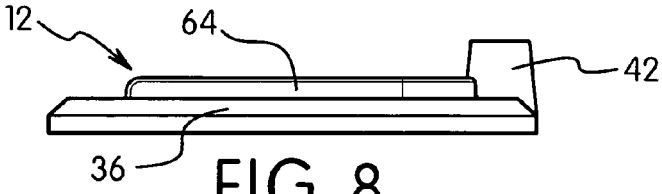
FIG. 8 is a side view of the cover plate of the electrical outlet assembly of FIG. 6.

Referring to FIGS. 3 and 6, the base plate 12 has a substantially planar configuration and typically has a dimension for attaching to an electrical wiring device 18 which is mounted in an electrical box 20. In the embodiment illustrated, electrical box 20 is a standard size electrical box for receiving a wiring device such as a duplex receptacle or switch. The electrical receptacle 18 is attached to the electrical box by screws 22 in a standard manner. Suitable electrical cables or wiring (not shown) are supplied to the wiring device through the electrical box 20. The duplex receptacle 18 in the illustrated embodiment is a standard receptacle having raised projecting portions 24 and a threaded hole 26 for receiving a mounting screw 28.

In the embodiment shown in FIGS. 1-12, electrical box 20 and outlet assembly 10 form a single gang unit. It will be understood that outlet assembly 10 can be constructed as a multi-gang unit. Similarly, the wiring device can be any suitable device such as a switch, outlet jack or receptacle. In the drawings outlet assembly 10 is shown with the assembly facing upwardly although in practice, the assembly can be oriented in any desired position. Typically, outlet assembly 10 is oriented with the front face being vertical so rain water can be directed away from the electrical receptacle.

In the embodiment illustrated, base plate 12 has a rectangular configuration corresponding to the shape of electrical box 20. Base plate 12 has a substantially planar configuration with a chamfered outer edge 30 to shed water, a longitudinal top edge 32, a longitudinal bottom edge 34, and side edges 36. Generally, base plate 12 is constructed to form a watertight seal with electrical box 20. An optional gasket can be provided between the base plate and the electrical box as needed.

Referring to FIG. 3, a hinge member 38 is formed on the top edge 32 of base plate 12. Hinge member 38 has a top wall 40 and side walls 42 extending upwardly from a top face 44 of base plate 12. Hinge member 38 includes a middle portion 46 to define two hinge receiving sections 48. A front lip 50 having a recess 52 on a lower surface thereof captures the cover 16 within the hinge receiving section 48 for pivoting movement. Preferably, hinge member 38 is formed as an integral one-piece member with base plate 12.

Top face 44 of base plate 12 in the embodiment illustrated includes two spaced apart access openings 54 for receiving the raised projecting portions 24 of the wiring device 18. Base plate 12 preferably has a thickness substantially equal to the height of the raised projecting portions 24 so that the top face 56 of wiring device 18 is substantially in the same plane as top face 54. A screw receiving aperture 58 extends through top face 44 of base plate 12 between access openings 54 for receiving mounting screw 28 to attach cover plate assembly to wiring device 18.

An inner rim 60 extends upwardly from top face 44 of base plate 12 and surrounds access openings 54. In the embodiment illustrated, inner rim 60 has a generally rectangular shape corresponding to the shape of base plate 12 with rounded corners 62. Inner rim 60 is spaced inwardly from the outermost edges of base plate 12 and outwardly from access openings 54. Inner rim 60 has a height sufficient to form a retaining ring for gasket 14 and to shed water away from access openings 54 when in use.

Figure 10:
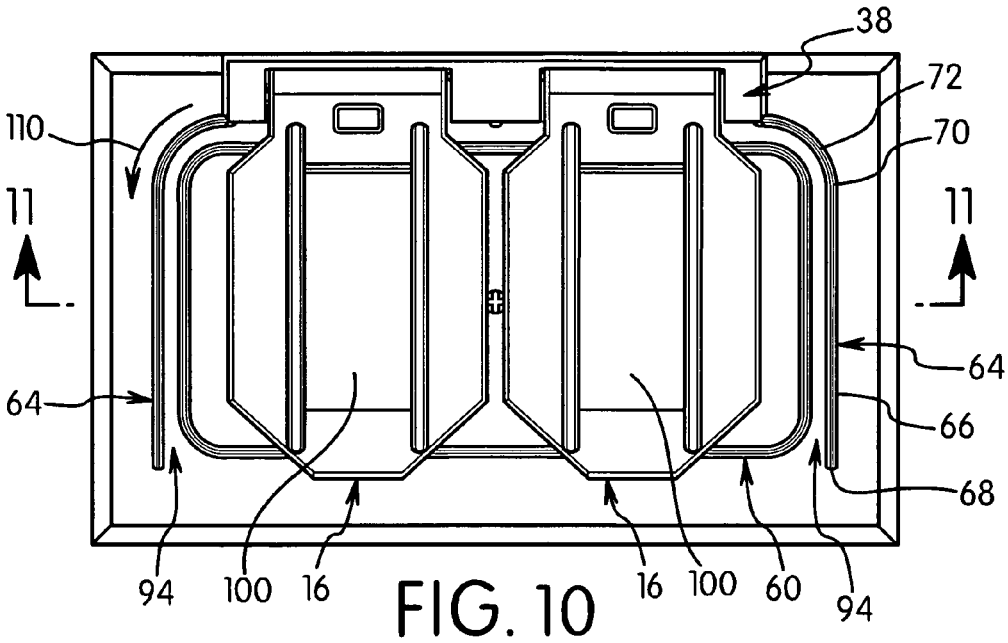
FIG. 10 is a front elevational view of the electrical outlet assembly oriented in a vertical position.

An outer rim 64, which forms a rain barrier or wall, is spaced outwardly from inner rim 60 and extends outwardly from top face 44 of base plate 12 and is substantially parallel to inner rim 60. As shown in FIG. 3, outer rim 64 is integrally formed with hinge member 38 to form a continuous outer rim extending along top edge 32 and side edges 36 of base plate 12. In the illustrated embodiments, the outer rim has an open bottom portion to shed water away from the electrical receptacle. Outer rim 64 includes side portions 66 that extend substantially parallel to side edges of inner rim 60. Hinge member 38 defines a top portion of outer rim 64 extending parallel to a longitudinal top side of inner rim 60. Side portions 68 have a terminal end spaced slightly beyond inner rim 60 as shown in FIGS. 6 and 10. A top end 70 of each side portion 68 has a curved corner portion 72 connected to hinge member 38.

Gasket 14 has a flat planar configuration with a shape and dimension corresponding to the inner dimension of inner rim 60 and is received within the cavity defined by inner rim 60. Gasket 14 has a top surface 74, a bottom surface 76 and an outer edge. Preferably gasket 14 has a thickness greater than the height of inner wall 60 and at least a thickness equal to the height of outer wall 66. Gasket 14 includes a plurality of openings shown in the drawings as slits 78 aligned with the recesses in the wiring device 18. The slits 78 have a dimension to receive the prongs of a plug 80 when the plug is inserted into the wiring device 18. Gasket 14 also includes an aperture 82 for receiving a ground prong of plug 80, and which is aligned with the ground connection 84 in wiring device 18.

A central aperture 86 is aligned with screw 28 and screw aperture 58 in base plate 12. In a preferred embodiment, aperture 86 in gasket 12 has a dimension less than the dimension of a head of screw 28 so that screw 28 is captured between base plate 12 and gasket 14 when gasket 14 is attached to the top surface of base plate 12. Aperture 86 has a dimension that is sufficient to allow the head of a screw driver to extend through gasket 14 to engage the screw head of screw 26 for tightening screw 26.

Figure 5:
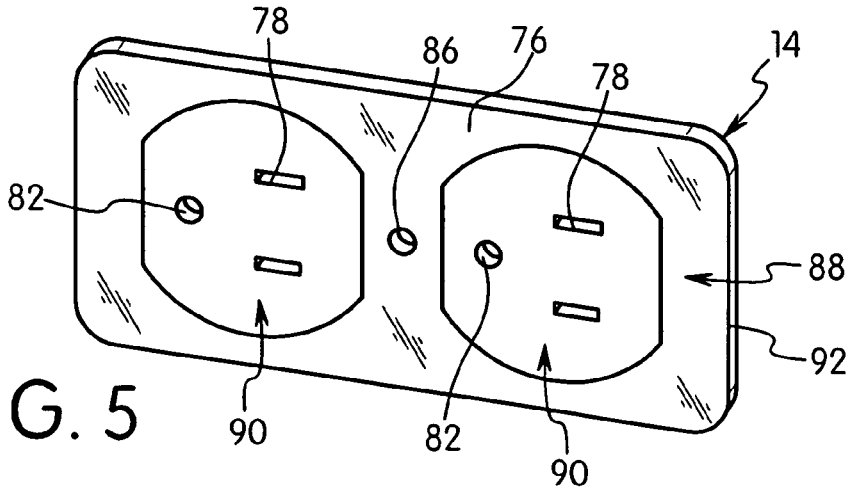
FIG. 5 is a perspective view showing the bottom side of the gasket and the adhesive material.

Preferably, gasket 14 is adhesively attached to base plate 12 to form a watertight seal around the access opening and to prevent the gasket from separating from the base plate. Referring to FIG. 5, in one embodiment of the invention bottom surface 76 of gasket 14 is provided with an adhesive coating or layer 88. As shown in FIG. 5, adhesive 88 extends around the perimeter of gasket 14 and along a middle portion to define an adhesive pattern corresponding to the shape and dimension of the top face of base plate within the inner rim 60. Bottom surface 76 of gasket 14 includes an area 90 that is free of adhesive 88 corresponding to the shape and dimension of access openings 54 in base plate 12. Gasket 12 is attached to the top face 44 of base plate 12 within inner rim 60 by adhesive 88 without the adhesive contacting the electrical receptacle. Aperture 86 in gasket 14 is smaller than the head of screw 28, so that gasket 14 captures screw 28 between base plate 12 and gasket 14 for ease of assembly with wiring device 18 and electrical box 20.

Figure 4:
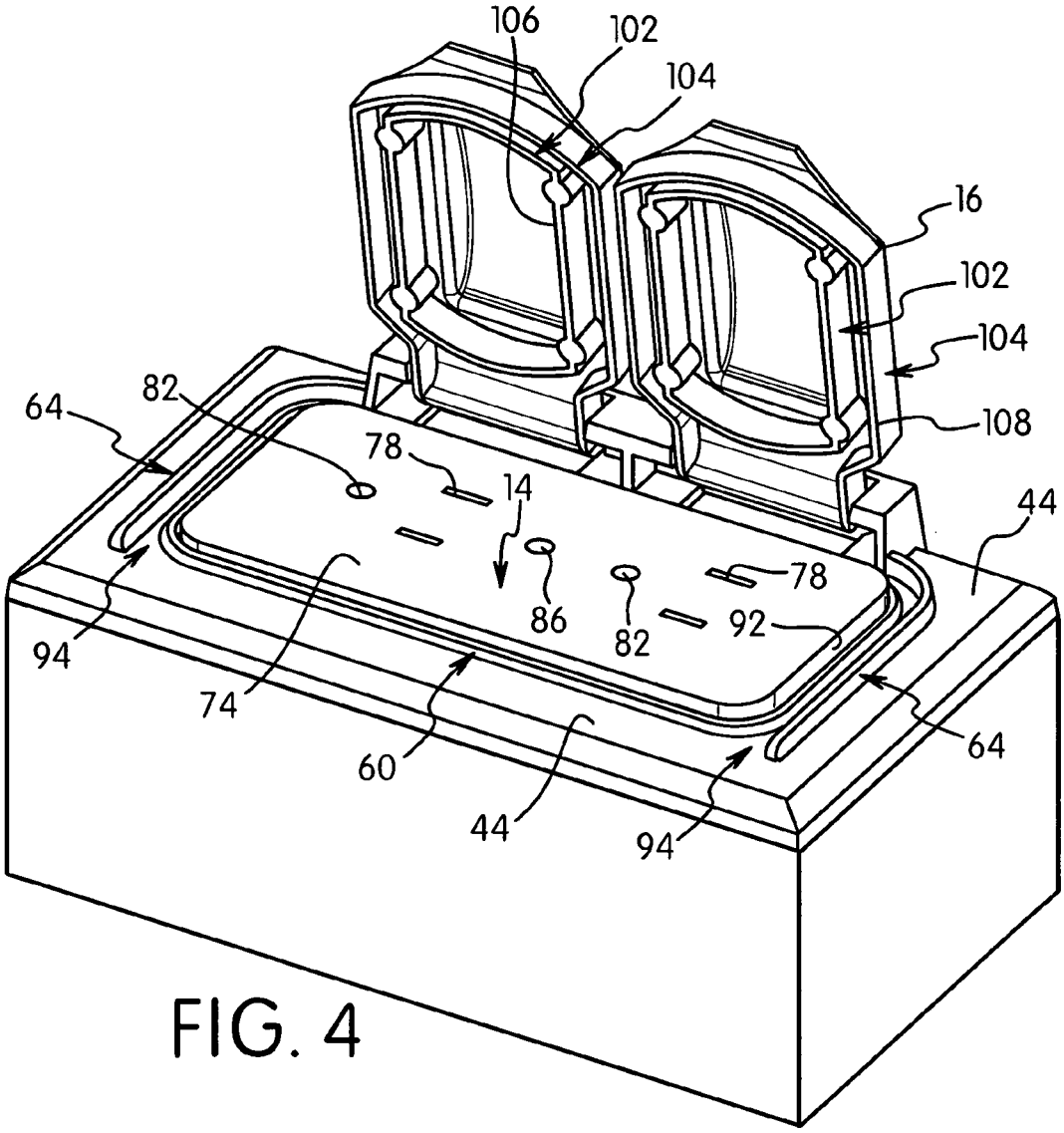
FIG. 4 is a perspective view of the electrical outlet assembly showing the covers in the open position.
Figure 11:
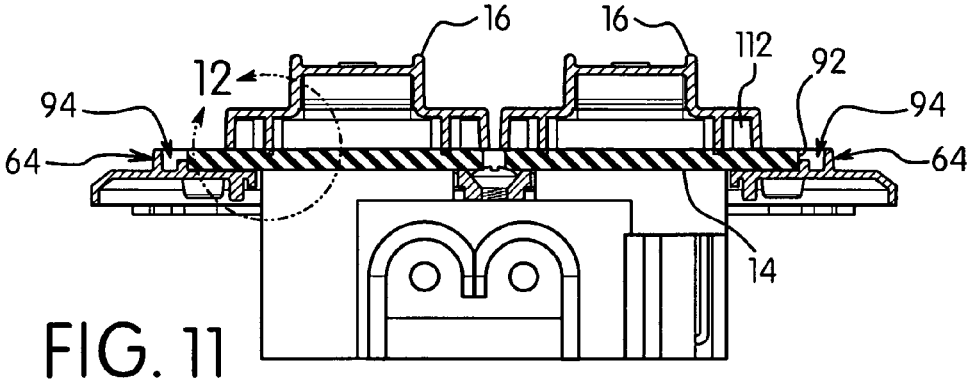
FIG. 11 is a cross-sectional view of the electrical outlet assembly taken along line 11-11 of FIG. 10.

As shown in FIGS. 4 and 11, gasket 14 has a thickness greater than a height of inner rim 60 and a thickness substantially equal to the height of outer rim 64. As shown in FIG. 11, outer rim 64, inner rim 60 and a side edge 92 form a channel 94 to direct rain water away from access openings 54 and wiring device 18 when assembly 10 is vertically oriented. In another embodiment, an adhesive is applied to top face 44 of base plate 12 within the boundary of inner rim 60 before attaching base plate 12 to the electrical receptacle. This ensures that the adhesive does not contact the face of the electrical receptacle.

In the embodiment illustrated, two spaced apart covers 16 are attached to hinge member 38 within the hinge receiving sections 48. A spring is provided to cooperate with hinge member 38 and covers 16 to spring bias covers 16 in a closed position. Covers 16 are independently movable from an open position shown in FIG. 4 to a closed position shown in FIG. 5.

Each cover 16 has a body 96 with a hinge pin 98 that is pivotally connected with the hinge receiving section 48 of hinge member 38. Body 96 of cover 16 has a top face 100, an inner rim 102 and an outer rim 104. Inner rim 102 is a continuous unitary member having a bottom edge 106 for contacting gasket 14. Inner rim 102 has a dimension to enclose the slit 78 and aperture 82 in gasket 14 corresponding to the wiring device 18. As shown in FIG. 4, bottom edge 106 of inner rim 102 has a continuous flat face for forming a seal against top surface 74 of gasket 14.

Outer rim 104 of cover 16 surrounds inner rim 102 and is spaced outwardly from inner rim 102. Outer rim 104 has a bottom edge 108 defining a substantially flat surface parallel to bottom edge 106 of inner rim 102.

In use of the electrical outlet assembly 10, screw 28 is initially passed through the screw opening 58 in base plate 12 and then gasket 14 is adhesively attached to the top surface of base plate 12 within the boundary of inner rim 60 as shown in FIG. 4. Base plate 12 is then attached to wiring device 18 mounted in electrical box 20 by screw 28. The head of the screwdriver can be passed through aperture 86 in gasket 14 to access the head of screw 28 to thread screw 28 into the threaded aperture of wiring device 18 thereby coupling base plate 12 to electrical box 20 and wiring device 18.

Gasket 14 is preferably formed from a resilient and compressible rubber material that does not absorb water. Examples of a suitable gasket material can be a butadiene rubber or a closed cell foam rubber such that the gasket material is flexible and compressible without absorbing water. During use, cover 16 is pivoted to an open position and the prongs of plug 80 are passed through the slits 78 of gasket 14 into engagement with the prong receiving apertures of the wiring device as shown in FIG. 1. Gasket 14 is sufficiently compressible so that a seal is formed between the inner face of plug 80 and gasket 14 to inhibit water and dirt from entering. Preferably, slits 78 in gasket 14 are self-sealing and have a dimension to allow the prongs of plug 80 to pass through gasket 14 and form a seal with the prongs. Upon removal of the plug 80, slits 78 return to the original shape and dimension so that the slits close upon removal of the plug thereby inhibiting water and dirt from entering and passing through to the wiring device.

Figure 12:
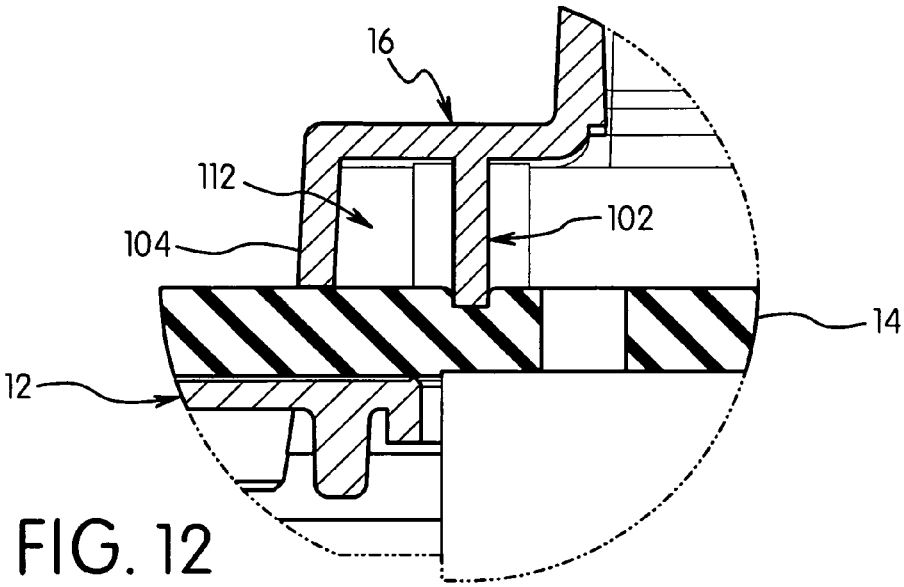
FIG. 12 is an enlarged partial cross-sectional view of FIG. 11 showing the cover forming a seal with the gasket of the electrical outlet assembly.

Referring to FIGS. 10, 11 and 12, electrical outlet 10 can be mounted in a vertical orientation for use outdoors and for providing a weatherproof cover for the wiring device. As shown in FIG. 10, top edge 32 of base plate 12 is oriented in an upward direction. When covers 16 are in a closed position as shown in FIG. 10, rain water is diverted away from the access openings 54 in base plate 12 by outer rim 64 as indicated by arrow 110. Channel 94 between inner rim 60 and outer rim 64 also assists in shedding rain water away from access openings 54.

Figure 9:
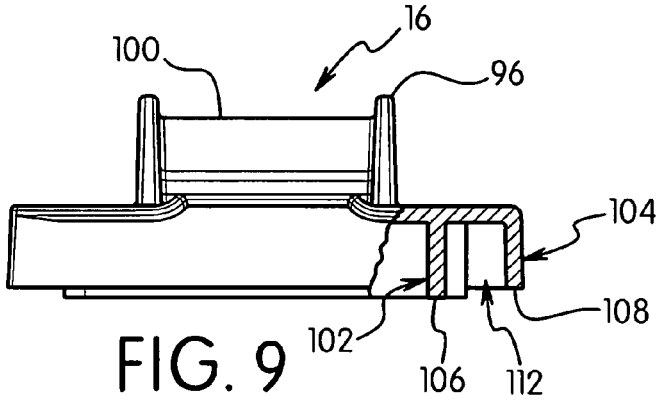
FIG. 9 is a front view of the cover in partial cross section.

As shown in FIG. 9, inner rim 100 of cover 16 has a length greater than a length of outer rim 104 to form a waterproof seal with gasket 14. Cover 16 is spring biased in a closed position so that bottom edge 106 of inner rim 102 contacts the top surface of gasket 14 to form a continuous seal. As shown in FIGS. 11 and 12, gasket 14 is sufficiently resilient and compressible to slightly compress by the force of the spring closing cover 16 so that bottom edge 106 of inner rim 102 becomes embedded in the top surface of gasket 14. Preferably, bottom edge 108 of outer rim 104 of cover 16 also engages the top surface of gasket 14 to assist in forming a waterproof seal. The space 112 between inner rim 102 and outer rim 104 of cover 16 define a channel to divert water away from the openings in gasket 14 and access openings 54 in base plate 12.

While various embodiments have been chosen to illustrate the invention, it will be understood by those skilled in the art that various changes and modifications can be made without departing from the scope of the invention as defined in the appended claims.

What is claimed is:

1. An electrical outlet cover assembly, comprising:

a base plate adapted for overlying an outlet box and a wiring device supported by the electrical box, the base plate having at least one access opening for aligning with the wiring device;

a cover coupled to said base plate, said cover being movable between a first open position and second closed position overlying the at least one access opening; and a resilient gasket having a top surface, a bottom surface, a peripheral outer edge and at least one opening aligned with said wiring device, said opening defining a self-sealing opening to access the wiring device, said resilient gasket having a bottom surface adhesively attached to a top surface of the base plate around the at least one access opening and covering the access opening to form a waterproof seal over the access opening and the wiring device, and where the gasket has a dimension to form a seal with the cover when the cover is in the closed position.

2. The electrical outlet of claim 1, wherein said base plate further comprises a top surface, a bottom surface and an inner rim extending upwardly from said top surface and surrounding said at least one access opening and where said gasket is positioned within said inner rim.

3. The electrical outlet of claim 2, wherein said gasket has an outer dimension complementing an inner dimension of said inner rim and where said inner rim is positioned to shed water away from said at least one access opening.

4. The electrical outlet of claim 3, wherein said gasket has a thickness greater than a height of said inner rim.

5. The electrical outlet of claim 2, further comprising, an outer rim extending upwardly from said top surface of said base plate and spaced outwardly from said inner rim and having a dimension sufficient to shed water away from said inner rim.

6. The electrical outlet of claim 5, wherein said outer rim has a height greater than a height of said inner rim.

7. The electrical outlet of claim 5, wherein said base plate includes a hinge member on one edge of said base plate, and where said outer rim is integrally formed with said hinge member, and where said cover is coupled to said hinge member.

8. The electrical outlet of claim 5, wherein said outer rim extends on three sides of said base plate around said inner rim and forms an open area on a fourth side.

9. The electrical outlet of claim 7, wherein said hinge member and outer rim are positioned to deflect water away from said inner rim.

10. The electrical outlet of claim 1, wherein said wiring device is an electrical receptacle having a plurality of slots for receiving prongs of an electrical plug, and where said opening in said gasket comprises a plurality of slits to form a waterproof seal with said prongs.

11. The electrical outlet of claim 1, wherein said cover includes an inner rim extending downwardly from a bottom side of said cover and having a dimension surrounding said access opening, and an outer rim extending downwardly from said bottom side of said cover and surrounding said inner rim, and where said outer rim of said cover has a height less than a height of said inner rim.

12. A weatherproof electrical outlet, comprising:

an electrical box having an open end and supporting an electrical receptacle;

a base plate coupled to said open end of said electrical box and overlying the electrical receptacle, said base plate having at least one access opening aligned with the electrical receptacle, a top face, a bottom face, and an inner rim surrounding said at least one access opening and extending upwardly from said top face and having a dimension to shed water away from said access opening;

a cover coupled to the base plate and being movable between a first open position and a second closed position overlying said at least one access opening, said cover having a dimension less than a dimension of said inner rim of said base plate;

a resilient gasket having a top surface, a bottom surface and a peripheral outer edge and at least one opening aligned with the electrical receptacle, said opening defining a self-sealing opening to access the wiring receptacle, said gasket overlying said top face and access opening and being attached to the top face of the base plate by an adhesive without being adhesively attached to the electrical receptacle, said gasket having an outer dimension to fit within an inner dimension of said inner rim on said base plate and forming a waterproof seal around said at least one access opening, and where said top surface of the gasket forms a seal with said cover when said cover is in the closed position.

13. The weatherproof outlet of claim 12, wherein said gasket has a thickness greater than a height of said inner rim.

14. The weatherproof outlet of claim 12, wherein the electrical receptacle has a projecting portion extending into said at least access opening, and where said gasket is free-floating on said electrical receptacle.

15. The weatherproof outlet of claim 12, said base plate further comprising an outer rim extending upwardly from said top face of said base plate and spaced outwardly from said inner rim and having a dimension sufficient to shed water away from said inner rim.

16. The weatherproof outlet of claim 15, wherein said outer rim has a height greater than a height of said inner rim.

17. The weatherproof outlet of claim 15, wherein said base plate has a top edge, a bottom edge and opposite side edges, and where said outer rim extends along said top edge and side edges and is open along said bottom edge.

18. The weatherproof outlet of claim 17, wherein said base plate is adapted for vertical use and includes a hinge member extending along said top edge and has a dimension to shed water away from said inner rim, and where said outer rim is integrally formed with said hinge member.

19. The weatherproof outlet of claim 12, wherein said electrical receptacle has a plurality of slots for receiving prongs of an electrical plug, and where said opening in said gasket comprises a plurality of self-sealing slits to form a waterproof seal with said prongs.

20. The weatherproof outlet of claim 12, wherein said cover includes an inner rim extending downwardly from said cover and surrounding said at least one opening in said gasket and access opening in said base plate, and an outer rim extending downwardly from said cover and surrounding said inner rim, said inner rim of said cover having a height that is greater than a height of said outer rim for forming a seal with said gasket.

21. The weatherproof outlet of claim 20, wherein said outer rim of said cover is spaced inwardly from said inner rim of said base plate.

22. The weatherproof outlet of claim 12, wherein said adhesive is provided on said bottom surface of said gasket in a pattern corresponding to said top surface of said base plate within said inner rim.

23. The weatherproof outlet of claim 12, wherein said base plate includes a mounting screw received within a screw hole in said base plate for coupling said base plate to the electrical receptacle, and where said screw is captured by said gasket adhesively attached to said base plate.

24. The weatherproof outlet of claim 23, wherein said gasket has an access hole aligned with said mounting screw, said access hole having a dimension less than an outer dimension of said mounting screw.

25. A weatherproof outlet comprising:

a base plate adapted to be coupled to an open end of an electrical box supporting an electrical receptacle and overlying said electrical receptacle, the base plate having two spaced-apart access openings for receiving projections on the electrical receptacle, a top face, a bottom face, a continuous inner rim surrounding the access openings and extending upwardly from the top face and having a dimension to shed water away from said access openings, said inner rim having an inner surface facing said access openings, an outer surface facing away from said access openings and a top edge between said inner and outer surfaces, and an outer rim extending upwardly from said top face and spaced outwardly from said inner rim and having a height greater than a height of said inner rim, said outer rim having a dimension to shed water away from said inner rim;

a cover coupled to said base plate and being movable between a first open position and a second closed position overlying at least one of the access openings, said cover having a dimension less than a dimension of said inner rim; and a resilient gasket having a top surface, a bottom surface, a peripheral outer edge and at least one opening aligned with the electrical receptacle, said opening defining an opening to access the electrical receptacle, said gasket being attached to the top surface of the base plate by an adhesive between the bottom surface of the gasket and the top surface of the base plate, said gasket having an outer dimension complementing an inner dimension of said inner rim on said base plate and forming a waterproof seal around the two access openings and forms a seal with the cover when the cover is in the closed position.

26. The weatherproof outlet of claim 25, wherein said outer rim extends along three sides of said base plate and defines an open area along a fourth side.

27. The weatherproof outlet of claim 25, wherein said base plate is adapted for vertical use and includes a top edge, a bottom edge and opposite side edges, said outer rim extending along said top edge and along said side edges, and where said outer rim is open along said bottom edge.

28. The weatherproof outlet of claim 25, further comprising a hinge member on one side of said base plate and where said outer rim is integrally formed with said hinge member, and said cover being coupled to said hinge member.

29. The weatherproof outlet of claim 25, wherein said cover includes an inner rim having a dimension to surround said opening in said gasket and an outer rim surrounding said inner rim, and where said inner rim of said cover has a height greater than a height of said outer rim.

30. The weatherproof outlet of claim 25, wherein said base plate includes a mounting screw received within a screw hole in the base plate, and where the screw is captured in the screw hole by the gasket and adhesively attached to said base plate.

31. The weatherproof outlet of claim 30, wherein said gasket has an access opening aligned with said mounting screw and having a dimension less than an outer dimension of said mounting screw.

32. The weatherproof outlet of claim 25, wherein said gasket has an inner portion to overlie said access openings and where said opening in said gasket is a self-closing slit.

33. The weatherproof outlet of claim 32, wherein said gasket has an adhesive on an outer portion to attach the gasket to said top face and where said inner portion is free of an adhesive.

34. A weatherproof outlet cover comprising:

a base plate adapted for coupling to an electrical box and covering an electrical receptacle, said base plate having a top face and a bottom face, an access opening extending between said top face and bottom face for receiving the electrical receptacle, a continuous inner rim extending upwardly from said top face and surrounding said access opening;

a cover coupled to said base plate and being movable between an open position and a closed position to overlie the access opening, said cover having a dimension less than said inner rim to fit within the periphery of said inner rim in the closed position; and a resilient gasket having a top surface, a bottom surface, a peripheral outer edge and at least one opening for accessing the electrical receptacle, said resilient gasket being attached to said top face of said base plate and having a portion covering said access opening in said base plate and having an outer dimension for mating with said cover to form a seal between said cover and said base plate.

35. The weatherproof outlet cover of claim 34, wherein said opening in said gasket is a self-sealing slit to form a waterproof seal.

36. The weatherproof outlet cover of claim 34, wherein said base plate further comprises an outer rim extending upwardly from said top face of said base plate and is spaced outwardly from said inner rim and spaced outwardly from said cover when said cover is in the closed position.

37. The weatherproof outlet cover of claim 34, wherein said resilient gasket is adhesively coupled to said base plate, and said portion covering said access opening does not have an adhesive.

38. The weatherproof outlet cover of claim 34, wherein said base plate has a screw aperture for receiving an attachment screw for attaching said base plate to the electrical box or the electrical receptacle; and said resilient gasket has an opening aligned with said screw aperture and has an inner dimension less than a width of the attachment screw.

39. The weatherproof outlet cover of claim 34, wherein said cover has an inner rim extending outwardly from a bottom face and having a dimension to surround said opening in said resilient gasket, and an outer rim extending outwardly from said bottom face and surrounding said inner rim and where said inner rim has a height greater than a height of said outer rim.

* * * * *